US008558823B2

(12) United States Patent
Nakatsuka

(10) Patent No.: US 8,558,823 B2
(45) **Date of Patent: *Oct. 15, 2013**

(54) LIQUID CRYSTAL DISPLAY AND GATE MODULATION METHOD THEREOF

(75) Inventor: Hitoshi Nakatsuka, Hsinchu (TW)

(73) Assignee: Au Optronics Corp., Hsin-Chu (TW)

( * ) Notice: Subject to any disclaimer, the term of this patent is extended or adjusted under 35 U.S.C. 154(b) by 318 days.

This patent is subject to a terminal disclaimer.

(21) Appl. No.: 13/085,190

(22) Filed: Apr. 12, 2011
(Under 37 CFR 1.47)

(65) Prior Publication Data

US 2011/0187690 A1 Aug. 4, 2011

Related U.S. Application Data

(63) Continuation of application No. 11/939,591, filed on Nov. 14, 2007, now Pat. No. 8,004,485.

(30) Foreign Application Priority Data

Nov. 16, 2006 (JP) ..... 2006-309872

(51) Int. Cl.
*G09G 5/00* (2006.01)

(52) U.S. Cl.
USPC ..... 345/208; 345/87; 345/94

(58) Field of Classification Search
USPC ..... 345/87–100, 204–214
See application file for complete search history.

(56) References Cited

U.S. PATENT DOCUMENTS

| | | | | |
|---|---|---|---|---|
| 5,398,043 | A | 3/1995 | Takeda et al. | |
| 6,359,607 | B1 | 3/2002 | Yanagi et al. | |
| 6,359,609 | B1 * | 3/2002 | Kuenster et al. | 345/156 |
| 6,894,313 | B2 | 5/2005 | Park et al. | |
| 7,646,367 | B2 * | 1/2010 | Kimura | 345/82 |
| 7,944,427 | B2 * | 5/2011 | Choi | 345/100 |
| 8,004,485 | B2 * | 8/2011 | Nakatsuka | 345/94 |
| 8,411,006 | B2 * | 4/2013 | Yanagi et al. | 345/92 |
| 2004/0251463 | A1 | 12/2004 | Park et al. | |
| 2005/0056934 | A1 | 3/2005 | Suzawa et al. | |
| 2005/0266593 | A1 | 12/2005 | Suzawa et al. | |
| 2006/0170641 | A1 * | 8/2006 | Song et al. | 345/98 |
| 2008/0030494 | A1 * | 2/2008 | Woo et al. | 345/212 |

FOREIGN PATENT DOCUMENTS

| | | |
|---|---|---|
| CN | 1282107 | 1/2001 |
| CN | 1574354 | 2/2005 |
| EP | 1071124 | 1/2001 |
| JP | 06110025 | 4/1994 |
| JP | 3406508 | 10/1999 |

OTHER PUBLICATIONS

Taiwanese language office action dated Mar. 26, 2012.
Chinese language office action dated Dec. 21, 2007.

* cited by examiner

*Primary Examiner* — William Boddie
*Assistant Examiner* — Mansour M Said
(74) *Attorney, Agent, or Firm* — McClure, Qualey & Rodack, LLP

(57) ABSTRACT

A gate modulation circuit is provided. A comparator compares a triangular wave voltage of a capacitor with a second reference voltage. If the triangular wave voltage of the capacitor exceeds the second reference voltage, a conduction path is turned off. A comparator controls desired discharge to a capacitor through a discharge resistor. Based on the discharge, power voltage (high level power voltage of the scanning driver) provided to the scanning driver is modulated, and outputted from the gate modulation circuit to the scanning driver as high level power voltage of the scanning driver.

1 Claim, 5 Drawing Sheets

LIQUID CRYSTAL DISPLAY AND GATE MODULATION METHOD THEREOF

CROSS REFERENCE TO RELATED APPLICATIONS

This present application is a continuation application of and claims priority from U.S. patent application Ser. No. 11/939,591, filed Nov. 3, 2007, the content of which is hereby incorporated by reference in its entirety.

BACKGROUND OF THE INVENTION

1. Field of the Invention

The invention relates generally to a liquid crystal display, and more particularly, to a liquid crystal display for reducing image mura.

2. Description of the Related Art

A liquid crystal display (LCD) is a high-resolution display with features of being thin, lightweight, and having low-voltage and low-power consumption. Sizes of LCDs, as broadly used, range from small-sized panels for mobile phones and digital cameras to over 40-inch large-sized panels for TVs.

An LCD operates by applying a voltage across liquid crystal material, sandwiched between two (i.e., a pair of) substrates with at least one transparent substrate, which changes the direction of liquid crystal orientation to control flux of light. Transparent electrical conduction films are formed on each pixel sandwiched between the two substrates for constructing a liquid crystal panel (i.e., between a pixel electrode arranged on a thin film transistor side substrate module and a counter electrode arranged on a counter electrode side substrate module). Therethrough, voltage is selectively applied to determine whether light of a specific pixel is transmitted or not.

FIG. 1 illustrates an equivalent circuit of a pixel of a conventional liquid crystal panel. As shown in FIG. 1, a thin film transistor (TFT) 13, as a switching component, and a storage capacitor 14 are formed on the intersection of a matrix respectively arranged by a scan line 11 and a data line 12 along X-axis and Y-axis on the substrate, wherein the storage capacitor 14 is formed to allow charging of an initial signal after inputting the signal to a pixel and before inputting a following signal.

Meanwhile, the drain electrode of the TFT 13 is coupled to one of the pixel electrodes, the source electrode is coupled to the data line 12, and the gate electrode is connect to the scan line 11. Also, an electrode (storage capacitor electrode) of a storage capacitor 14 installed on the same substrate with the TFT 13 is coupled to the drain electrode of the TFT 13. In addition, another electrode of the pixel is a common electrode connected to a common voltage $V_{COM}$ formed on an opposing substrate.

As shown in FIG. 1, $C_{lc}$ illustrates an equivalent capacitor of a liquid crystal cell, $C_{gd}$ illustrates a parasitic capacitor across the drain and the gate of the TFT 13, and $C_s$ illustrates a storage capacitor. $C_s$ is connected in parallel to the liquid crystal capacitor $C_{lc}$ formed by liquid crystal material, and is utilized to be the load of the TFT 13. A terminal of $C_s$ is connected to the drain/source of the TFT 13 and the other terminal of $C_s$ is connected to the scan line or the voltage $V_{COM}$. The other electrode of the storage capacitor 14 shown in FIG. 1 is coupled to a part of the display electrode (an auxiliary voltage $V_S$ as shown in FIG. 1.

If the scan line is at a high level ($V_{GH}$), the data voltage is stored in the pixel capacitor $C_{lc}$ according to the voltage provided by the data line. When the level of the scanning signal transitions from a high level ($V_{GH}$) to a low level ($V_{GL}$), the drain voltage of the TFT 13 generates a level shift, which is called feed-through voltage, wherein the level shift ($\Delta V_d$) is represented by the following formula:

$$\Delta V_d = C_{gd}/(C_{gd}+C_{lc}+C_s)\times(V_{GH}-V_{GL})\circ$$

FIG. 2 illustrates a level shift of a drain voltage $V_d$ of a TFT according a conventional driving method. As shown in FIG. 2, in the same scan line (the $j_{th}$ scan line), a gate voltage ($V_g$) and a drain voltage ($V_d$) of the TFT is corresponding to the pixels on the first and the $n_{th}$ location near the input of the scanning signal.

When the voltage level of the scanning signal drops rapidly, the falling inclination edge on each scan line of the TFT is dependent on where it is located on the scan line due to the delay effect. The TFT turns off after the scan line voltage is below a threshold voltage, thereby increasing the level shift ($\Delta V_d$ (1, j) as shown in FIG. 2 near the input on the scan line, and decreasing the level shift ($\Delta V_d$ (n, j) as shown in FIG. 2 near the end on the scan line. That is, the level shift $\Delta V_d$ of the drain voltage of the TFT on the same scan line becomes inconsistent and causes image mura such as flickers and residues, thus lowering display image quality for large liquid crystal panels.

As a result, various researches, e.g., Patent Reference 1 (Japan Pat. Appl. Kokai Publication No. 6-110025) and Patent Reference 2 (Japan Pat. Appl. Kokoku Publication No. 3406508), were directed to a method of changing the falling edge of the scanning signal as an inclination (ramp waveform) to reduce the aforementioned image mura.

For controlling the falling edge of the scanning signal as an inclination, the conventional and broadly-used timing integrated circuits and a scan line driver need to be modified, and thus it raises a problem of developing new timing integrated circuits and scan line drivers.

BRIEF SUMMARY OF THE INVENTION

Accordingly, the present invention provides a gate signal modulation circuit for eliminating or decreasing display image mura such as flickers and residues without specially modifying structures of a timing integrated circuit and a scanning driver installed in a liquid crystal display.

In order to solve the above described problems, the present invention provides a liquid crystal display, comprising a plurality of parallel data lines, a plurality of scan lines perpendicular to a plurality of data lines, pixels installed at each intersection of the plurality of data lines and the plurality of scan lines, thin film transistors (TFTs) corresponding to each pixel, a data line driving circuit for providing a data line signal, and a scan line driving circuit for providing a scan line. The liquid crystal display further comprises a gate signal modulation circuit. The gate signal modulation circuit comprises a first capacitor coupled to a constant current circuit, a voltage generation circuit for discharging a voltage of the first capacitor to synchronize with the timing scanning signal and generating a triangle wave voltage, a second capacitor coupled to a high level power of the scan line driving circuit, and a discharging circuit to stop providing the high level power voltage of the scan line driving circuit according to a result of comparing the triangle wave voltage and a basis voltage and discharge the voltage of the second capacitor to modulate a falling edge waveform of the scan line timing signal being outputted to the scan line driving circuit.

A gate signal modulation circuit according to the present invention comprises a power voltage for supplying operating power to the circuit, a basis voltage for supplying a basis voltage to the circuit, a constant current generator for generating a constant current, a first capacitor coupled to the constant current generator for generating a charging voltage, a triangle wave generator with a control node coupled to a timing signal for controlling a falling edge and a rising edge of a gate signal, which generate a triangle wave voltage for the first capacitor voltage according to the timing signal, a modulation controller for outputting a modulated control signal based on a comparison result between the triangle wave voltage and the basis voltage, and a modulated voltage generator comprising a second capacitor coupled to the power voltage, wherein the modulated voltage generator determines whether the second capacitor is charged by the source or discharged according to the modulated control signal and generates a modulated voltage.

In order to easily understand the purposes, features, and advantages of the present invention, a detailed description is given in the following embodiments with reference to the accompanying drawings.

BRIEF DESCRIPTION OF DRAWINGS

The present invention can be more fully understood by reading the subsequent detailed description and examples with references to the accompanying drawings, where.

DETAILED DESCRIPTION OF THE INVENTION

Figure 1:
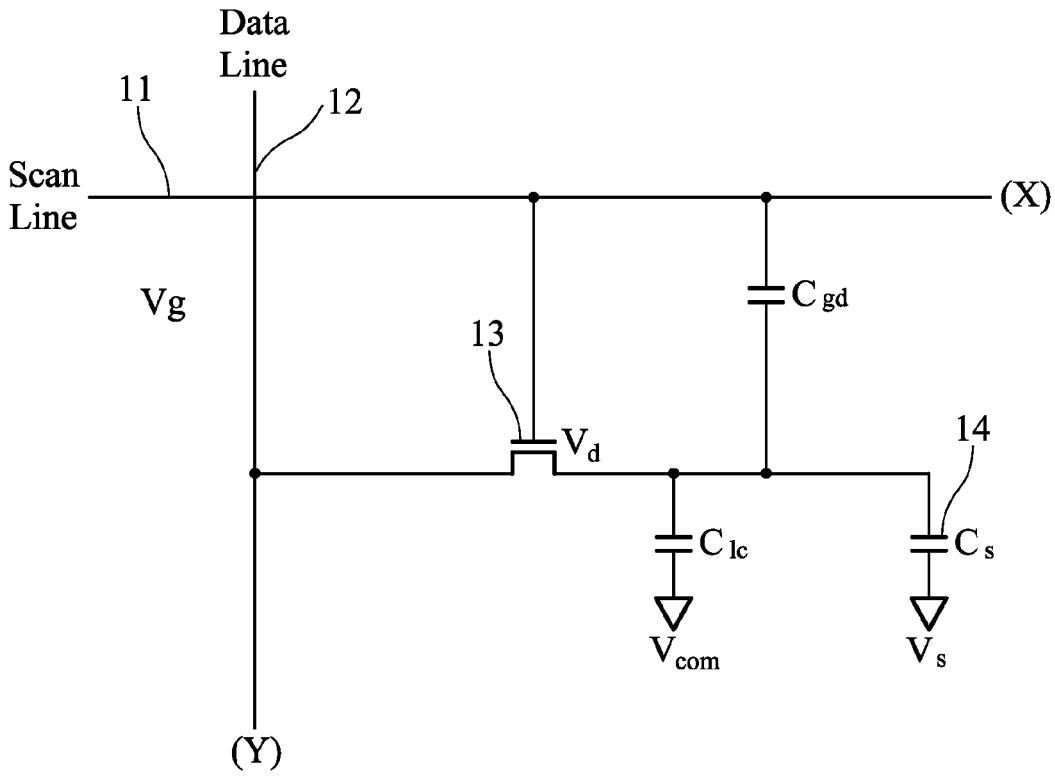
FIG. 1 ( PRIOR ART )
FIG. 1 illustrates an equivalent circuit of a pixel of a conventional liquid crystal display panel.
Figure 2:
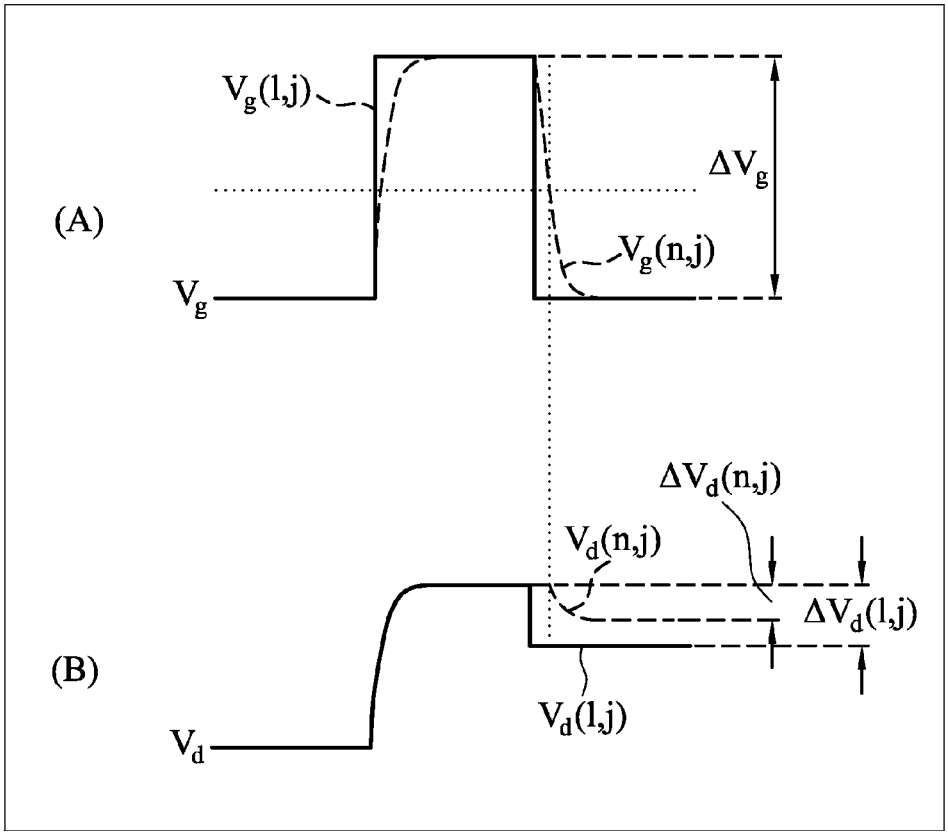
FIG. 2 ( PRIOR ART )
FIG. 2 illustrates a level shift of a drain voltage of a TFT according to a conventional driving method.
Figure 3:
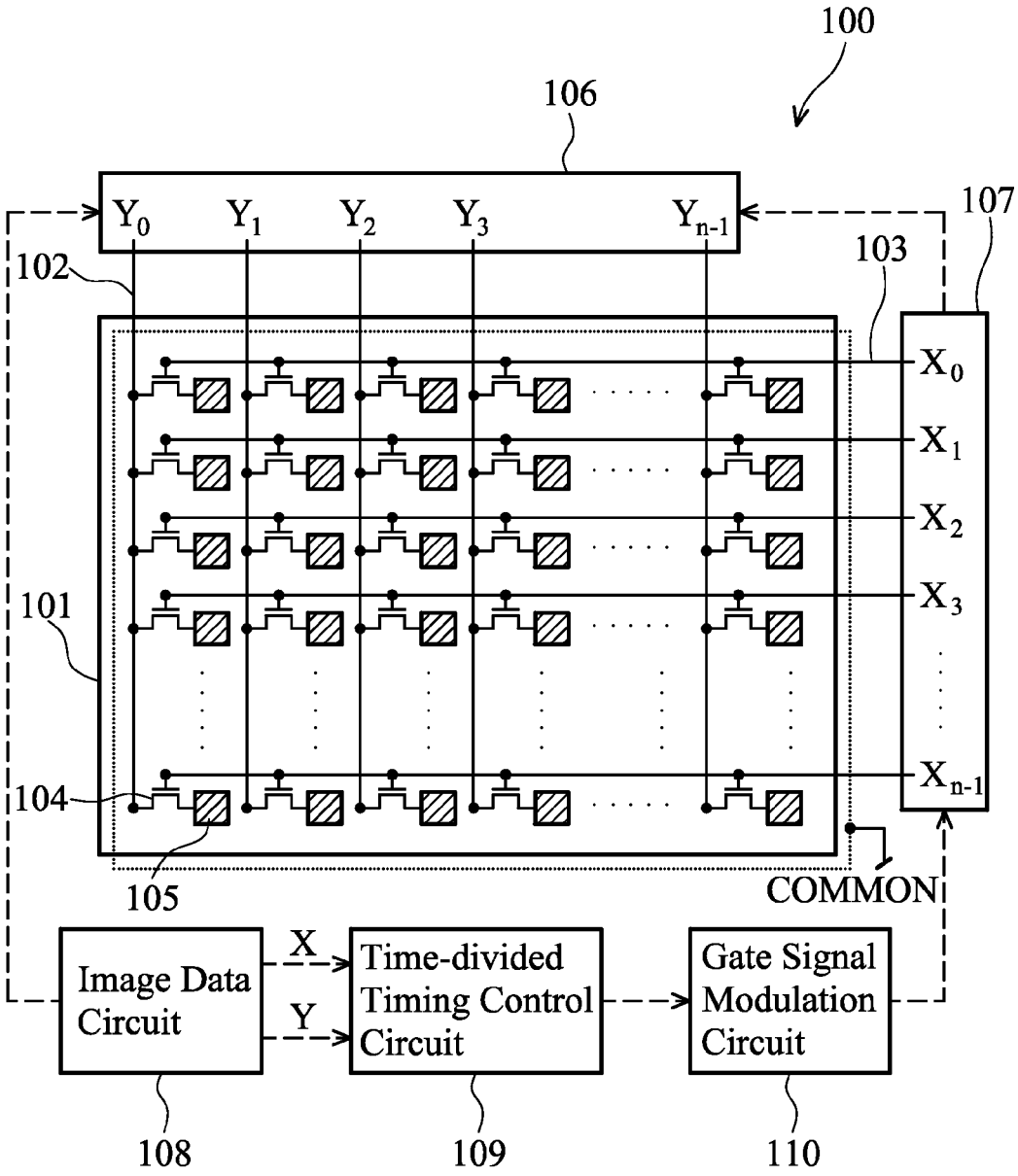
FIG. 3 illustrates a liquid crystal display according to an embodiment of the present invention.

FIG. 3 illustrates a schematic diagram of a liquid crystal display according to the present invention. A TFT 104 as a switch component and a storage capacitor (not shown) are installed at each intersection of a data line 102 and a scan line 103 arranged in an n row by n column matrix on a substrate 101 of a liquid crystal display 100, wherein the drain of the TFT 104 is coupled to a pixel electrode 105, the source of the TFT 104 is coupled to the data line 102, and the gate of the TFT 104 is coupled to the scan line 103.

An image data circuit 108 outputs an image signal to a data driving circuit (a data driver) 106 and a time-divided timing control circuit 109 outputs a timing signal to a scan line driving circuit (a scan line driver) 107 through a gate signal modulation circuit 110.

Figure 4:
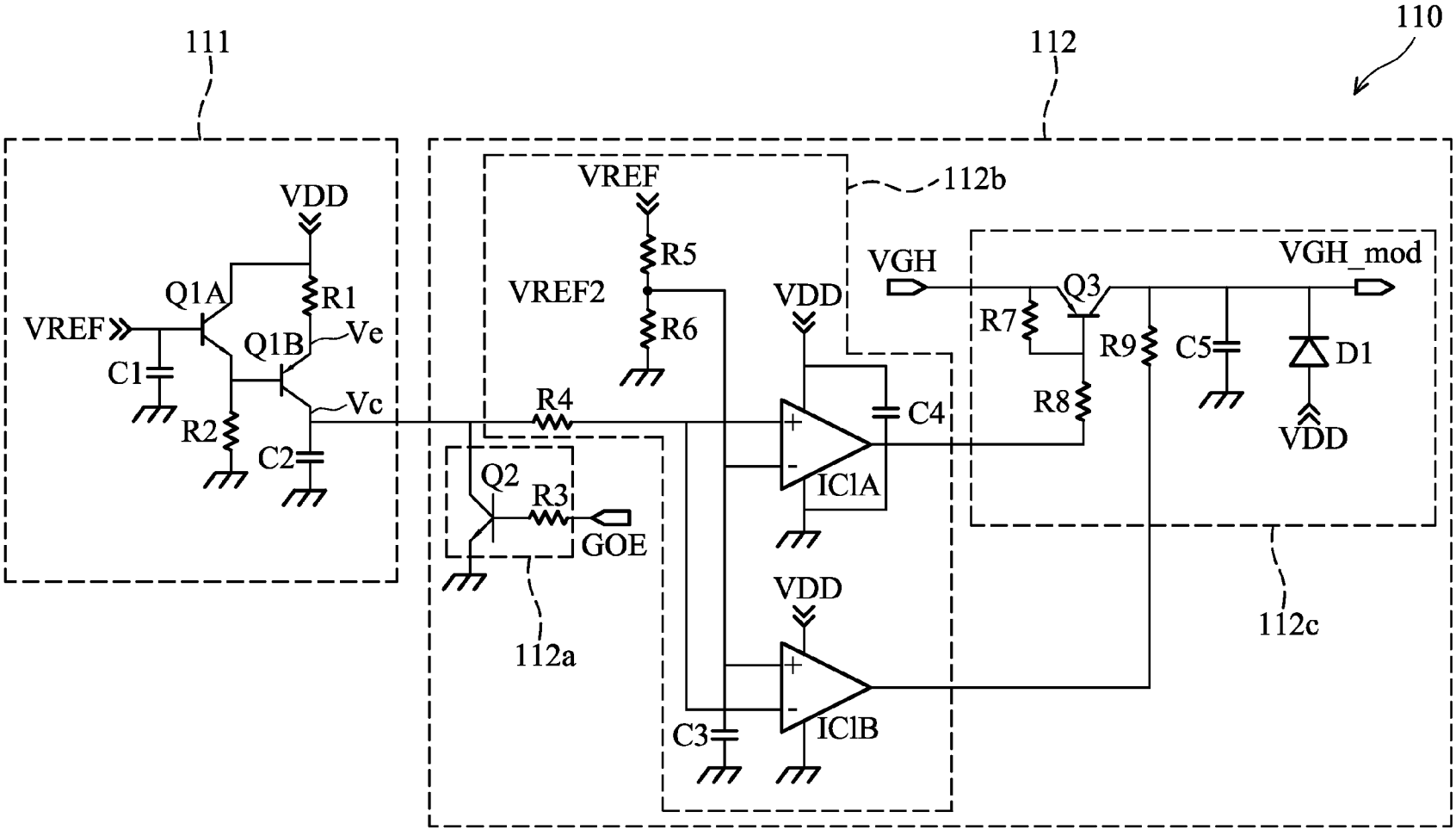
FIG. 4 illustrates a gate signal modulation circuit of a liquid crystal display according to another embodiment of the present invention.

FIG. 4 illustrates a gate signal modulation circuit 110 of a liquid crystal display according to another embodiment of the present invention. In FIG. 4, a block 111 represents a constant current circuit (or a constant current generator) of the gate signal modulation circuit 110 and a capacitor C2. A block 112 represents a modulation kernel circuit for controlling a gate signal, which comprising a voltage generation circuit 112*a* (in the embodiment, for example, a triangle wave generation circuit composed of a transistor Q2 and a resistor R3), a discharging circuit (not shown) composed of a modulation controller 112*b* and a modulated voltage generator 112*c*. According to the embodiment, the discharging circuit at least comprises comparators IC1A and IC1B, a transistor Q3, resistors R7~R9, and a capacitor C5.

The constant current circuit 111 comprises a complex PNP bipolar junction transistor Q1B and a complex NPN bipolar junction transistor Q1A with an emitter coupled to the ground. The base of the NPN bipolar junction transistor Q1A is supplied by a basis voltage VREF, wherein the basis voltage VREF is outputted to the base of the PNP bipolar junction transistor Q1B through the emitter of the NPN bipolar junction transistor Q1A.

At this time, the emitter voltage of the NPN bipolar junction transistor Q1A is lower than the basis voltage VREF by a base-emitter voltage $VBE_A$ of the NPN bipolar junction transistor Q1A (=VRFE−$VBE_A$), wherein the voltage VRFE−$VBE_A$ is applied to the base of the PNP bipolar junction transistor Q1B coupled to the emitter of the NPN bipolar junction transistor Q1A.

The emitter voltage Ve of the PNP bipolar junction transistor Q1B is higher than the base voltage of the PNP bipolar junction transistor Q1B by a base-emitter voltage $VBE_B$ of the PNP bipolar junction transistor Q1B (=VRFE−$VBE_A$+$VBE_B$).

Here, the base-emitter voltage of the complex NPN bipolar junction transistor Q1A is almost the same with that of the PNP bipolar junction transistor Q1B. Consequently, the emitter voltage Ve of the PNP bipolar junction transistor Q1B almost equal to the basis voltage VREF and is a voltage independent of the base-emitter voltage VBE of the bipolar junction transistor. Therefore, a stable constant voltage independent of temperature variation is implemented.

The emitter voltage Ve of the PNP bipolar junction transistor Q1B is coupled to a digital power VDD through a transistor R1, and a capacitor C2 coupled to the collector of the PNP bipolar junction transistor Q1B flows a constant current I=(VDD−VREF)/R1.

The collector of the PNP bipolar junction transistor Q1B is coupled to the emitter of the transistor Q2 of a triangle generation circuit 112. A gate output enable signal GOE is inputted to the base of the transistor Q2 through a resistor R3, wherein the gate output enable signal GOE is a timing signal for controlling a rising edge and a falling edge of the gate signal.

The collector voltage Vc of the PNP bipolar junction transistor Q1B is determined by the formula Vc=I×t/C2, and the charge stored in the capacitor C2 is correlated with the constant current (I=(VDD−VREF)/R1).

The charge stored in the capacitor C2 (charging voltage) is discharged through the transistor Q2. The discharging through the transistor Q2 is performed according to the GOE signal to control the rising edge and the falling edge of the gate signal (timing signal).

Figure 5:
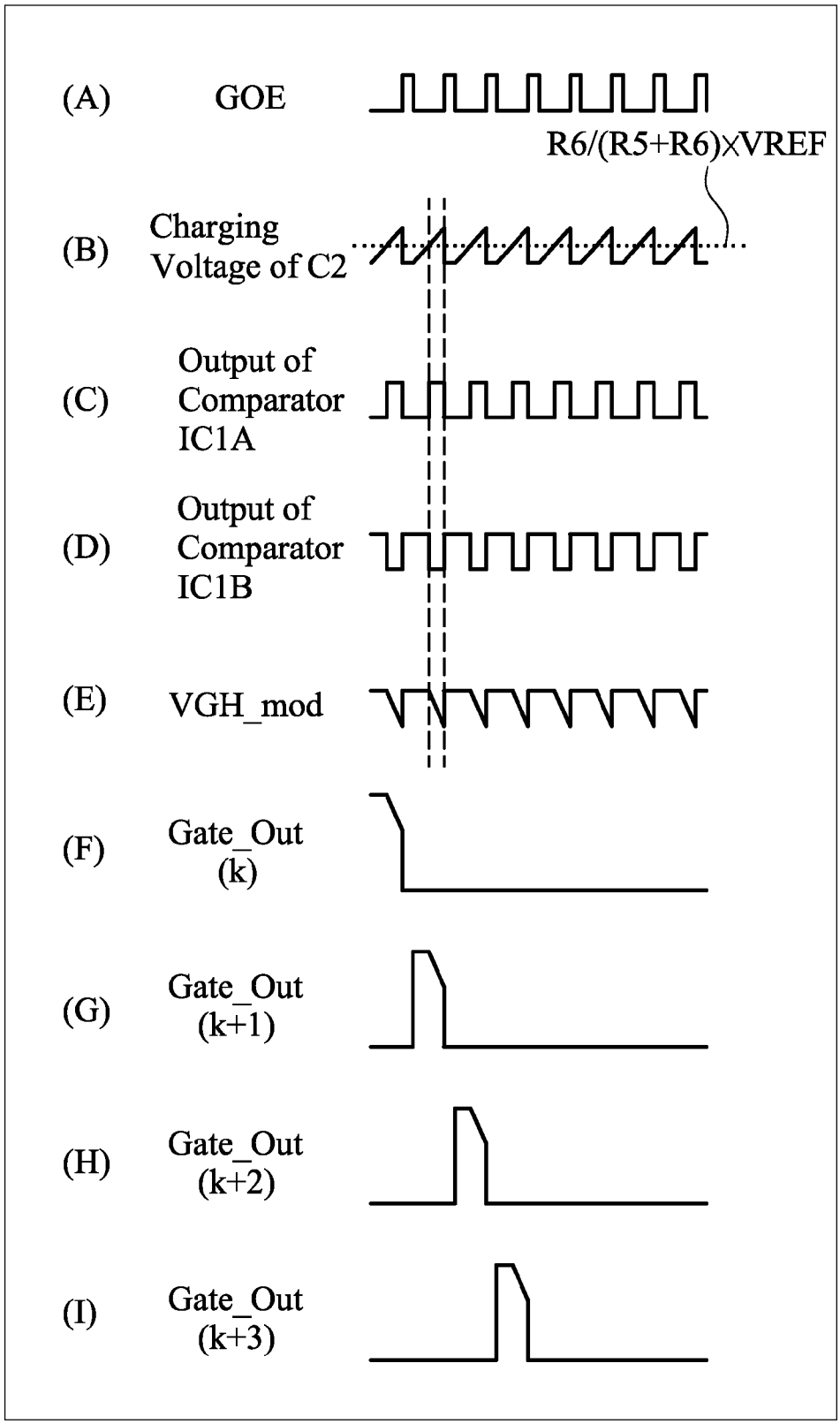
FIG. 5 illustrates timing waveforms of GOE signal (A), charging voltage of a capacitor C2 (B), output of a comparator IC1A (C), output of a comparator IC1B (D), modulation of power voltage provided to a scan line driver (E), and scan lines of the scan line driver ((F)~(I)).

Consequently, as shown in a timing diagram of FIG. 5, the charging voltage waveform of the capacitor C2 synchronously varying with the GOE signal (as shown in FIG. 5(A)) and the charge voltage of C2 is a triangle wave that rises at a predetermined inclination angle from the falling edge of the GOE signal, and drops rapidly at the rising edge of the GOE signal (as shown in FIG. 5(B)).

According to one embodiment of the present invention, the rising edge of the GOE signal is synchronous with the falling edge of the output of the scan line driver 107, and the falling edge of the GOE signal is synchronous with the rising edge of output of the scan line driver 107, so as to control the output of the scan line driver. Therefore, the charging voltage of the capacitor C2 rises in the predetermined inclination angle synchronously with the rising edge of the output of the scan line driver, and falls synchronously with the falling edge of the output of the scan line driver.

The charging voltage of the capacitor C2 is respectively outputted to a non-inverter node (+) of a comparator IC1A and an inverter node (−) of a comparator IC1B through a resistor R4. The inverter node (−) of the comparator IC1A and the non-inverter node (+) of the comparator IC1B are coupled to a second basis voltage point (VREF2=(R6×VREF)/(R5+R6)), wherein the second basis voltage is determined by a resistance ratio of two resistors (R5, R6) which are serially connected between the basis voltage VREF and the ground.

The comparator IC1A compares the voltage of the capacitor C2 and the second basis voltage VREF2. The turn-on path (referring to FIG. 5(C)) of the transistor Q3 is turned off when the voltage of the capacitor C2 exceeds the second basis voltage VERF2.

Moreover, the comparator IC1B outputs a logic "0" when the comparator IC1A outputs a logic "1" and outputs a logic "1" when the comparator IC1A outputs a logic "0" (referring to FIG. 5(D)). When the voltage of the capacitor C2 exceeds the second basis voltage VREF2, the voltage of a capacitor C5 is discharged through a discharging resistor R9. According to the discharging operation, the power voltage (a high level power voltage VGH of the scan line driver) provided for the scan line driver 107 is modulated and outputted from the gate signal modulation circuit 110 to the scan line driving circuit 107 as the high level power voltage of the scan line driving circuit.

Specifically, a comparator utilizes an open collector output. The comparator utilizing the open collector output can reduce essential transistors (such as a transistor for turning on/off the Q3 and a transistor for discharging the capacitor C5).

When the comparator IC1A outputs a logic "1" (i.e., an internal transistor is turned off), no current flows through a resistor R8 and the transistor Q3 is off to cut off a conduction path. In addition, when the comparator IC1A outputs a logic "0" (i.e., the internal transistor is turned on), a current flows through the resistor R8 and the transistor Q3 is turned on to conduct the path.

Moreover, the operation of the comparator IC1B and the comparator IC1A is opposite to each other. When the comparator IC1B outputs a logic "1" (the internal transistor is off), the voltage of the capacitor C5 is maintained due to no current flowing through the path from the capacitor C5 to the resistor R9. When the comparator IC1B outputs a logic "0" (the internal transistor is on), the charge of the charged capacitor C5 is discharged through the resistor R9. Therefore, the discharging curve is determined by a time constant of the capacitor C5 and the resistor R9.

According to one embodiment of the present invention, a modulated waveform of power voltage provided to the scan line driver begins to incline before the output of the scan line driver 107 falls, and stops inclining during falling of the output of the scan line driver 107 (referring to FIG. 5(E)).

The period of providing the power voltage to the scan line driver is determined by the second basis voltage VREF2 and the inclination angle of the triangle wave from the charging voltage of the capacitor C2. Additionally, the inclination angle of the modulated waveform from the power voltage of the scan line driver is determined by the capacitor C5 and the discharging resistor R9.

Further, the high level power voltage of the gate signal modulation circuit 110 coupled to the scan line driver 107 sequentially outputs scan line signals Gate_out(k)~(k+3) with inclination at the falling edge from the gate of the scan line driver, referring to FIG. 5(F)~(I), through the $k_{th}$ scan line, the $k+1_{th}$ scan line, the $k+2_{th}$ scan line, and the $k+3_{th}$ scan line (below skipped).

As shown in FIG. 4, at the output side of the gate signal modulation circuit 110, a diode D1 is installed between the high level power VGH of the scan line driver and the digital power VDD. When the output voltage of the gate signal modulation circuit is lower than the digital power VDD, short circuit of the scan line driver 107 may occur. Therefore, the diode D1 is installed to avoid the above problem, thereby improving reliability of the scan line driver 107.

As described above, the present invention provides a liquid crystal display which can easily modulate the falling edge of the scan line signal as a ramp and reduce liquid crystal display image mura.

While the present invention has been described by way of examples and in terms of preferred embodiment, it is to be understood that the present invention is not limited to thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A gate signal modulation circuit, comprising:

a power voltage for providing operating power to the circuit;

a basis voltage for providing a basis voltage to the circuit;

a constant current generator for providing a constant current;

a first capacitor coupled to the constant current generator for providing a charging voltage;

a triangle wave generator comprising a control node receiving a timing signal for controlling a rising edge and a falling edge of a gate signal to generate a triangle wave voltage for the first capacitor according to the timing signal;

a modulation controller for outputting a modulated control signal according to a comparison result of the triangle wave voltage and the basis voltage; and a modulated voltage generator comprising a second capacitor coupled to the power voltage, wherein the modulated voltage generator determines whether the second capacitor is charged by the power or discharged according to the modulated control signal and generates a modulated voltage.

* * * * *